United States Patent [19]

Sirine et al.

[11] 3,997,460

[45] Dec. 14, 1976

[54] LIQUID ABRASIVE CLEANER

[75] Inventors: Gloria F. Sirine, Pleasanton; Inesis A. J. Day, Alameda; Stephen J. Kahn, Walnut Creek, all of Calif.

[73] Assignee: The Clorox Company, Oakland, Calif.

[22] Filed: Apr. 10, 1975

[21] Appl. No.: 566,908

[52] U.S. Cl. ..... 252/106; 134/3; 134/42; 252/142; 252/145; 252/DIG. 14

[51] Int. Cl.[2] ..... C11D 1/72; C11D 3/14

[58] Field of Search ..... 252/106, 123, 128, 136, 252/139, 140, 142, 143, 145, 317, DIG. 14; 4/222, 228; 134/3, 41, 42

[56] References Cited

UNITED STATES PATENTS

| | | | |
|---|---|---|---|
| 2,672,449 | 3/1954 | Snell et al. | 252/100 |
| 3,169,905 | 2/1965 | Lambert | 424/80 |
| 3,325,415 | 6/1967 | Kenney et al. | 252/144 |
| 3,630,929 | 12/1971 | van Digk | 252/136 |
| 3,681,141 | 8/1972 | Muoio | 134/41 |
| 3,709,823 | 1/1973 | Sugahara et al. | 252/136 |
| 3,793,221 | 2/1974 | Otrhalck et al. | 252/136 |

FOREIGN PATENTS OR APPLICATIONS

| | | |
|---|---|---|
| 666,723 | 7/1966 | Belgium |
| 1,767,992 | 10/1971 | Germany |

*Primary Examiner*—P.E. Willis, Jr.
*Attorney, Agent, or Firm*—Phillips, Moore, Weissenberger Lempio & Strabala

[57] ABSTRACT

The invention relates to a surface adherent abrasive liquid cleaner which is especially useful for removing hard water, iron and organic stains as might be found in toilet bowls. The cleaner includes a mineral acid such as hydrogen chloride to aid in dissolving the stains. An abrasive is suspended in the cleaner to aid in mechanically scrubbing off the stains. A particular suspending agent comprising hydrophillic silica, at times used in combination with a secondary suspending agent preferably comprising an metal silicate, forms a part of the cleaner. Sufficient of the suspending agent is used to make the cleaner free-flowing and to stably suspend the abrasive but still to leave the cleaner viscous enough to adhere to a smooth surface such as porcelain and to the stains. A non-ionic surfactant forms a part of the composition. An effective disinfectant can also form a part of the composition.

9 Claims, No Drawings

LIQUID ABRASIVE CLEANER

BACKGROUND OF THE INVENTION

A number of liquid acidic cleaners useful for removing hard water, iron and organic (fecal and algae) stains,from toilet bowls and the like are known. Such cleaners have not had abrasive adequately suspended therein and methods of adequately suspending abrasive therein have not previously been known. Also, means of retaining suspended abrasive detergent compositions and effective disinfectants adherent to a smooth surface such as porcelain in the vicinity of a stain for maximal usefulness thereof in removal of said stain have not previously been known.

It would be highly desirable to provide a surface adherent abrasive liquid non-gelled cleaner with the abrasive always maintained in suspension therein which is free-flowing but still viscous enough to adhere to a smooth vertical surface adjacent a stain and to the stain itself. It would be even more advantageous if such a cleaner contained a disinfectant which would work in conjunction with the mineral acid and the abrasive to remove stains whereby additional disinfecting could be accomplished.

Accordingly, it is an object of the present invention to provide a cleaner having the above-desired qualities.

SUMMARY OF THE INVENTION

Briefly, the invention comprises a surface adherent abrasive liquid cleaner useful for removing stains and a process for making said cleaner. The cleaner consists essentially of the following ingredients:

1. A mineral acid in an amount of at least about 2%;
2. A suspending agent comprising at least about 0.5% hydrophilic silica, sufficient of said suspending agent being used to make the cleaner free-flowing but still viscous enough to adhere to a smooth surface;
3. A non-ionic surfactant in an amount within the range from about 0.05% to about 5%;
4. An abrasive agent maintained in suspension in an amount within the range from about 2% to 40%; and
5. At least about 25% water beyond that water present in the mineral acid, all of said percents being by weight.

The cleaner can also preferably include an effective disinfectant in an amount which falls within the range from about 0.05% to about 8%.

DETAILED DESCRIPTION OF THE PREFERRED EMBODIMENT

All of the percent figures mentioned herein are weight percents based upon the total weight of the cleaner.

The cleaner of the present invention comprises a carefully balanced blend useful for removing stains. The blend is an abrasive liquid cleaner. The liquid cleaner retains an abrasive agent suspended therein. Because of the careful balancing of the suspending agent, acid, surfactant, and abrasive agent components of the cleaner, it remains liquid (non-gelled) and retains the abrasive agent suspended therein through the significant temperature fluctuations often encountered on shipment and on storage.

The viscosity of the cleaner is such that it is viscous enough to adhere to a smooth vertical surface adjacent hard water, iron and/or fecal stains as might be found inside of a toilet bowl and to the stains themselves. This is important since the mineral acid present in the cleaner can then most effectively attack the calcium and/or magnesium and/or iron salts which comprise the stains. Also, because of this fairly high viscosity, the abrasive agent is kept adjacent the stains and is most effectively used in scrubbing the stains off. It is, of course, clear that if the cleaner were low in viscosity then the abrasive would tend to disperse throughout the entire volume of, for example, a toilet bowl, and thus would be only partially effective at best in providing abrasive qualities where needed, namely at the stains.

An effective disinfectant also preferably forms a part of the composition. This is useful not only to generally disinfect a toilet bowl but is also particularly useful when kept in the vicinity of stains by the viscosity of the solution since the disinfectant then tends to operate effectively to attack and destroy bacteria which are often associated with such stains and which often serve to glue or cement such stains together and protect such stains from the attack of a mineral acid and from scrubbing with an abrasive.

The mineral acid most often used in the composition is hydrochloric acid because of its ready availability, low cost and high effectiveness. Other mineral acids, such as, for example, phosphoric acid, sulfuric acid and the like, can also be used however. Generally, at least about 2% by weight of the mineral acid is required to effectively dissolve away the hard water and iron stains. The mineral acid also serves to provide very effective short term disinfectant action. More preferably the mineral acid is present in amounts which fall within the range from about 5% to about 12% for home use although higher amounts, e.g., up to 30% are also useful in industrial cleaners. A most preferred range of mineral acid concentration is from about 6% to about 10%.

To provide significant cleaning properties to the cleaner composition, it is desirable and in fact necessary, that a non-ionic surfactant be present generally in an amount which falls within the range from about 0.5% to about 5%. Any of the common commercial poly(oxyalkylene) alcohols such as those of the non-ionic Triton (alkylphenoxy polyethoxy ethanols as described in "Triton alkylphenoxy surfactants", Rohm and Haas, Philadelphia, 1966) and Pluronic $$(HO(CH_2CH_2O)_a\,(\underset{\substack{|\\ CH_3}}{CH}\,CH_2O)_b\,(CH_2CH_2O)_c\,H$$

where a,b and c are integers, marketed by BASF Wyandotte Corporation) series are suitable non-ionic surfactants. It is important that the amount of non-ionic surfactant fall within the range from about 0.05% to about 5%. Triton X-100 and Pluronic P75 both are usable in the cleaner with the Pluronic P75 being preferred because only a single component suspending agent is then needed. More preferably, the amount of non-ionic surfactant should fall within the range of about 0.1% to about 3%. It is important that the concentration of the non-ionic surfactant remain within the desired range since if the concentration is too low, insufficient cleaning power will result. If the concentration is too high the viscosity of the cleaner, when a highly effective (for this use) surfactant is utilized, is reduced so much that the cleaner does not effectively adhere to a smooth vertical surface adjacent and on hard water stains. Thus, with highly effective surfactants such as Pluronic P75, it is most preferred that there be 0.1% to 0.5% of the surfactant present. With somewhat less effective surfactant such as Triton X-100, the use of about 2% is desirable.

An abrasive agent must be present and suspended in the cleaner in an amount within the range from about 2% to about 40%. More preferably, the abrasive agent will be present in an amount which falls within the range from about 5% to about 25% and still more preferably in an amount from about 5% to about 15%. Any suitable acid stable abrasive agent may be used, although sand is preferred because of its ready availability and low cost. Generally, the abrasive agent should be present in a particle size within the range from about 40 to about 400 mesh. The preferred mesh size is 140 to 200 mesh. When the particles are in the 100 to 400 mesh and preferably 140 to 200 mesh size range they can be readily suspended into a homogeneous stable liquid dispersion, yet they are large enough to provide adequate scouring properties. Other abrasive agents such as, for example, kaolin, pumice, diatomite, tripoli, siliceous clay, feldspar, etc. may be partially or completely substituted for the sand. The amount of the abrasive agent should not be less than about 2% or sufficient abrasive properties will not result, and the concentration should not be greater than about 40% or difficulty will result in obtaining a homogeneous and stable liquid dispersion. Generally, the abrasive agent should have a Mohs Hardness value within the range from about 2to about 7. Softer abrasive agents are only partially effective and harder abrasive agents may damage porcelain surfaces of toilet bowls, sinks and the like. With abrasives having a Mohs Hardness of 2 – 3, the particle size should be larger than about 250 microns (60 mesh) and with abrasives having a Mohs Hardness above about 5.5 (which are hard enough to scratch porcelain) the particle size should be no larger than 100 microns and preferably no larger than about 50 microns (270 mesh).

An effective disinfectant should preferably be present in an amount within the range from about 0.05% to about 8%. The preferred disinfectant is a quaternary ammonium compound although other compatible disinfectants as well can be utilized. Preferably the disinfectants should be present in an amount within a range from about 0.5% to about 5% if it is a quaternary ammonium compound. Any of a number of quaternary ammonium compounds can be used. Generally, the quaternary ammonium compound will comprise a halide with a quaternary ammonium cation having a molecular structure such as:

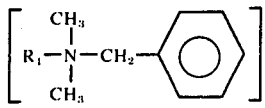

where $R_1 = C_{12} - C_{18}$ or

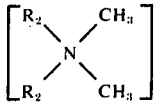

where $R_2 = C_8 - C_{10}$

One particularly preferred quaternary ammonium compound comprises a commercially available mixture of octyldecyldimethylammonium chloride, dioctyldimethylammonium chloride and didecyldimethylammonium chloride with the trademark BARDAC-20 marketed by Lonza, Inc, and described in "BARQUAT and BARDAC Quaternary Ammonium Compounds", L-40, Fair Lawn, 1973. Rohm and Haas Company markets a useful quaternary ammonium compound under the trademark Hyamine 3500 and Onyx Chemical Company markets another such compound under the trademark BTC 2125M. Both of these compounds are of the benzyl alkyl ammonium cation type. Useful phenolic disinfectants include 2,2′ methylenebis (4-chlorophenol) and its water soluble salts in concentrations of 0.05% to 1%. This compound is available under the Preventol trademark from General Aniline & Film Corporation and is described in "Preventol GD and Preventol GDC", Technical Bulletin 7543–065, General Aniline & Film Corporation, 1966.

A particular suspending agent is necessarily used in the composition of the present invention. The suspending agent must comprise at least about 0.5% hydrophilic silica. Preferably the amount of hydrophilic silica falls within the range from about 1% to about 5%. Hydrophilic silica is a relatively low bulk density particulate powdery material capable of forming hydrogen bonds with water when dissolved therein. Generally, the hydrophilic silica will have a large surface area, usually of at least 100 $m^2$/gram, preferably falling within the range from 100 $m^2$/gram to 500 $m^2$/gram and most preferably falling within the range from about 150 $m^2$/gram to about 250 $m^2$/gram. Commercially available fumed silica, made by decomposing $SiCl_4$ in the presence of water vapor (such as a product sold under the trademark Cabosil M-5 by Cabot Corporation, Boston, Massachusetts) is an especially useful form of hydrophilic silica. Hydrophilic silica of suitable properties can also be made by careful precipitation of silica from solution. Precipitated hydrophilic silica is available commercially, for example, from Philadelphia Quartz Company and is sold under the trademark QUSO. Further description of this type of hydrophilic silica and its preparation is found in U.S. Pat. No. 3,208,823. When sufficient quantities of hydrophilic silica are dissolved in a water solution a thixotropic gel will result. The amount of hydrophilic silica used in the cleaner of the present invention is always kept below that which would cause the formation of a thixotropic gel. This is useful to insure that the cleaner will have adequate free-flowing characteristics without the necessity for agitating it to temporarily break a gel.

The hydrophilic silica must in some cases be used in combination with at least about 0.01% of a co-suspending agent, for example, a colloidal hydrophilic polysaccharide such as xanthan gum and the like or a metal silicate. A metal silicate is preferred over a polysaccharide because of the long term compatability and stability of the former in an acid medium. The preferred class of metal silicates are aluminum silicate, magnesium silicate, magnesium aluminum silicate, and mixtures thereof. Preferably from about 0.02% to about 1% of the preferred metal silicate is used.

As previously mentioned, it has been found that with some non-ionic surfactants, e.g., with Triton X-100 a co-suspending agent is needed while with other non-ionic surfactants, e.g., Pluronic P75 a co-suspending agent is not needed. This can be very simply tested for particular non-ionic surfactants by simply making up a cleaner solution of the present invention without a co-suspending agent and noting whether the abrasive agent remains suspended therein without gelling thereof. If not, a co-suspending agent is used in conjunction with the hydrophilic silica.

Sufficient of the suspending agent is used to keep the abrasive suspended and to make the cleaner free-flowing so it can readily be poured or squirted out of a bottle or the like but still be viscous enough to adhere to a smooth surface and to stains.

The remainder of the composition, generally at least about 25% beyond that present in the acid, is water although various adjuvants, odors and the like may be added as is well known in the art. A dye may very advantageously be added to the cleaner in sufficient quantity to impart a color thereto. With the particular cleaner of the present invention, the color serves a very distinct purpose other than simply making the cleaner more aesthetically pleasing. In particular, the color indicates what portions of the bowl, for example, adjacent stains, the cleaner has adhered to. And, because of the adherenet properties of the cleaner, the person making use of it then knows whether each portion of the stains within the bowl have sufficient, but not excess, cleaner adjacent them so that they can be effectively scrubbed.

In order to obtain a homogeneous stable liquid dispersion the order of mixing of the ingredients of the cleaner is important. In particular, it is necessary that the suspending agent be dispersed in the water prior to the mixing of the abrasive therewith and that the abrasive be added with sufficient agitation to lead to the formation of a stable homogeneous dispersion. If this is not done, the abrasive will settle out of solution and a homogeneous liquid dispersion will not result. The other components of the cleaner are then admixed with the resulting stable homogeneous dispersion.

The invention will be better understood by reference to the following illustrative examples. It is to be understood that the examples are meant to be illustrative only and that the invention is not meant to be limited thereto.

EXAMPLE 1

A batch of 7.40 pounds of 140 mesh fumed silica (Cabosil M-5) was added to 227.81 pounds of tap water with high shear mixing. Twenty eight hundredths of a pounds of a synthetic clay mineral comprising a mixed magnesium aluminum silicate was added to the water-silica blend and mixed therewith. Thereafter, 37.38 pounds of 160 mesh sand was added to the water-suspending agent mixture with violent agitation to form a homogeneous dispersion. Ninety five pounds of hydrochloric acid (31.45% active/20° Be) was then added to the dispersion and mixed therewith. Pluronic P-75, a nonionic surfactant obtained from BASF Wyandotte (0.56 lbs.) was heated to about 60° C to convert it from a paste to a liquid and mixed with 0.93 pounds of methyl salicylate, 3.74 pounds of a mixed quaternary ammonium disinfectant comprising octyldecyldimethylammonium chloride, dioctyldimethylammonium chloride and didecyldimethylammonium chloride (BARDAC 20, EPA reg. No. 6836-19, Lonza, Inc.) and 0.56 pounds methylene blue dye in 1% aqueous solution. The resulting four-component mixture was then mixed in with the previous combination of suspending agent, abrasive, water and hydrochloric acid. The batch was stirred to insure proper solution. A total of 40 gallons, (373.83 lbs.) of a homogeneous stable liquid dispersion resulted.

The resulting composition was a liquid useful for cleaning toilet bowls. The abrasive remained in suspension in the composition on storage. The composition was sufficiently viscous to adhere to the internal surface of the bowls and to stains within the bowls, but was still free-flowing enough to be easily squirted out of a container and onto the surfaces of the bowls. The methylene blue dye served to mark those portions of the bowl that had been properly coated with the cleaner. The methyl salicylate served to impart a desired fragrance to the cleaner. The quaternary ammonium compound provided an effective disinfectant which adhered adjacent the stains along with the other components.

EXAMPLE 2

Other useful cleaners in accordance with the present invention were made with the composition shown in the following two tables:

Disinfectant: Hydrochloric acid and quaternary Ammonium compound

| Ingredient | % by Weight |
|---|---|
| Hydrochloric acid, 20° Be | 37.30 |
| Fumed silica | 2.00 |
| Xanthan gum | 0.30 |
| Kaolin | 5 – 10 |
| Alkylphenoxy alcohol (Triton X-100) | 2.00 |
| Quaternary ammonium compound (BARDAC 20) | 1.00 |
| Fragrance (Methyl salicylate) | 0.25 |
| Dye (Methylene Blue) | 0.006 |
| Water | & 52.144–47.144 |

Disinfectant: Hydrochloric acid and Quaternary Ammonium compound

| Ingredient | % by Weight |
|---|---|
| Hydrochloric acid, 20° Be | 37.30 |
| Fumed silica | 2.00 |
| Xanthan gum | 0.40 |
| Sand, 160 mesh | 20.00 |
| Alkylphenoxy alcohol (Triton X-100) | 2.00 |
| Quaternary ammonium compound (BARDAC 20) | 1.00 |
| Fragrance (Methyl salicylate) | 0.25 |
| Dye (Methylene Blue) | 0.0015 |
| Water | 37.0485 |

Both of these compositions retained the abrasive in suspension on storage and were useful for cleaning toilet bowls. These compositions adhered to the internal bowl surfaces but were free-flowing enough to be easily squirted out of a container and onto said bowl surfaces.

EXAMPLE 3

This example illustrates the preparation of a cleaner in accordance with the present invention wherein a single suspending agent was utilized. Fully effective suspension of the abrasive was achieved. The composition was sufficiently viscous to adhere to the internal surface of toilet bowls and to stains thereon, but was still free-flowing enough to be easily squirted out of a container and onto the surfaces of the bowls. The cleaner had the composition shown in following:

| Ingredient | % by Weight |
|---|---|
| Hydrochloric acid, 20° Be | 37.30 |
| Fumed silica | 2.00 |
| Pluronic P-75 | 0.15 |
| Sand, 140 Mesh | 20.00 |
| Quaternary ammonium compound (BARDAC 20) | 1.00 |
| Fragrance (Methyl salicylate) | 0.25 |
| Dye (Methylene Blue) | 0.0015 |

-continued

| Ingredient | % by Weight |
|---|---|
| Water | 39.2985 |

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A surface-adherent liquid disinfectant cleaner with an abrasive stably and homogeniously dispersed therethroughout useful for removing stains, consisting essentially of:

a mineral acid selected from the group consisting of phosphoric acid, sulphuric acid and hydrochloric acid in an amount which falls within a range from about 2% to about 30%;

a suspending agent comprising from about 0.5% to about 5% hydrophilic silica, sufficient of said suspending agent being used to make the cleaner free-flowing but still viscous enough to adhere to a smooth surface;

a non-ionic poly (oxyalkylene) alcohol surfactant in an amount which falls within the range from about 0.05% to about 5%;

an abrasive agent which is 40 to 400 mesh in size maintained in suspension in an amount which falls within the range from about 2% to about 40%; and the remainder water, all of said percents being by weight.

2. A cleaner as in claim 1, wherein said mineral acid comprising hydrochloric acid in an amount within the range from about 5% to about 12%, said hydrophilic silica is present in an amount which falls within the range from about 1% to about 5%, said non-ionic surfactant is present in an amount within the range from about 0.1% to about 1%, and said abrasive agent is present in an amount within the range from about 5% to about 25%.

3. A cleaner as in claim 2, wherein said suspending agent includes at least about 0.01% of an a metal silicate.

4. A cleaner as in claim 3, wherein said metal silicate is selected from the group consisting of magnesium silicate, aluminum silicate, magnesium aluminum silicate and mixtures thereof and is present in an amount which falls within the range from about 0.02 to about 1%.

5. A cleaner as in claim 4 including a dye in sufficient quantity to impart a color thereto.

6. A cleaner as in claim 4 including an effective water soluble disinfectant in an amount which falls within the range from about 0.05% to about 8%.

7. A cleaner as in claim 6, wherein said disinfectant comprises a quaternary ammonium compound in an amount within the range from about 0.5% to about 5%.

8. A cleaner as in claim 4, wherein said abrasive agent comprises sand in an amount from about 5% to about 15%.

9. A process for formulating a surface-adherent disinfectant cleaner with an abrasive stably and homogeniously dispersed therethroughout useful for removing stains comprising:

dispersing a suspending agent comprising from about 0.5%, to about 5% hydrophilic silica in water, sufficient of said suspending agent being used to make the cleaner free-flowing but still viscous enough to adhere to a smooth surface to form a dispersion;

adding to said dispersion an abrasive agent which is 40 to 400 mesh in size in an amount which falls within the range from about 2% to about 40% with sufficient agitation to stably and homogeniously suspend said abrasive agent in said dispersion; and admixing with said abrasive agent containing dispersion a mineral acid selected from the group consisting of phosphoric acid, sulphuric acid and hydrochloric acid in an amount which falls within the range from about 2% to about 30% and a non-ionic poly (oxyalkylene) alcohol surfactant in an amount which falls within the range from about 0.05% to about 5%.

* * * * *